United States Patent [19]

Lucas

[11] 4,134,492

[45] Jan. 16, 1979

[54] COFFEE CUP AND CONTAINER

[76] Inventor: Paul A. Lucas, 2605 St. Clair Ave., East Liverpool, Ohio 43920

[21] Appl. No.: 811,432

[22] Filed: Jun. 29, 1977

Related U.S. Application Data

[63] Continuation-in-part of Ser. No. 735,111, Oct. 22, 1976, abandoned.

[51] Int. Cl.[2] ..... B65D 25/08; B65D 85/72

[52] U.S. Cl. ..... 206/217; 220/90.6; 426/86

[58] Field of Search ..... 206/217, 218; 220/90.6; 426/86

[56] References Cited

U.S. PATENT DOCUMENTS

| | | | |
|---|---|---|---|
| 2,062,897 | 12/1936 | Michel et al. | 426/86 |
| 2,328,798 | 9/1943 | Gardner | 229/14 BE |
| 3,690,509 | 9/1972 | Kinoian et al. | 220/90.6 |

*Primary Examiner*—William T. Dixson, Jr.
*Attorney, Agent, or Firm*—Webster B. Harpman

[57] ABSTRACT

A coffee cup and container for a beverage concentrate comprises an expendible cup and a plastic film liner therefor positioning the beverage concentrate between the liner and the cup bottom. The liner overlaps the rim of the cup and is attached thereto so as to form a convenient easily handled section enabling the liner to be removed when the beverage concentrate is to be used as by adding water thereto.

5 Claims, 3 Drawing Figures

COFFEE CUP AND CONTAINER

This is a continuation-in-part of application Ser. No. 735,111, filed Oct. 22, 1976, now abandoned.

BACKGROUND OF THE INVENTION (1) Field of the Invention

This invention relates to expendible cups wherein a beverage concentrate such as an instant coffee product is packaged by a closure.

(2) Description of the Prior Art

Prior articles of this type have employed cup-like containers and various means for retaining a beverage concentrate therein. See for example U.S. Pat. No. 1,336,839 wherein wax discs form first and second bottoms therein with the concentrate therebetween, U.S. Pat. No. 1,709,168 wherein a disc with an elongated extension forms a false bottom containing the concentrate, U.S. Pat. No. 2,972,406 illustrating a variation of the foregoing disc and extension, U.S. Pat. No. 3,407,922 wherein a separate compartmented bottom portion is affixed to a bottomless cup and U.S. Pat. No. 3,870,220 wherein a tearable disc with an elongated extension forms a closure on a secondary container disposed in a cup.

This invention eliminates the discs, false bottoms and multiple part cups of the prior art and provides a simple, less expensive single use cup and container for a beverage concentrate.

SUMMARY OF THE INVENTION

A coffee cup and container for a beverage concentrate comprises an expendible single use cup with a plastic film liner overlapping the rim of the cup and secured thereto to locate the beverage concentrate in the cup under the liner in a suitable package formed by the cup and liner.

DESCRIPTION OF THE PREFERRED EMBODIMENT

Figure 1:
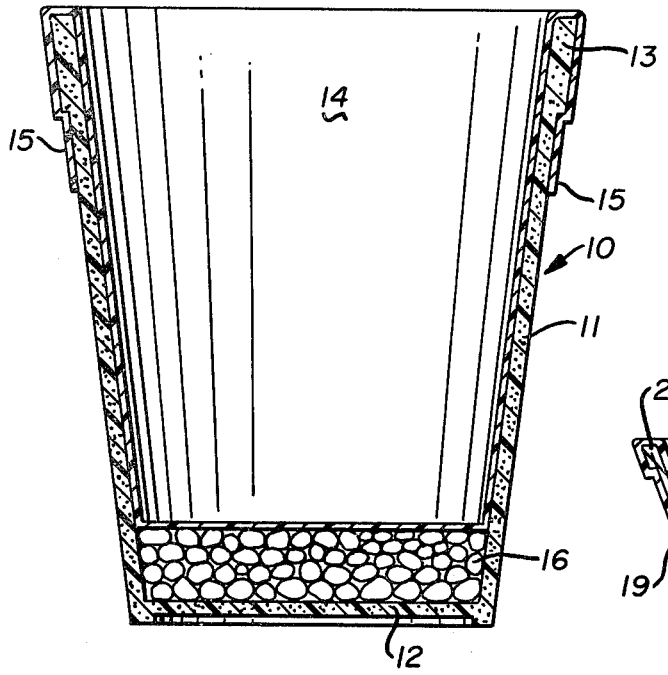
FIG. 1 is a vertical section through an expendible cup embodying the present invention.

In its simplest form the coffee cup and container for a beverage concentrate of this invention may be seen in FIG. 1 of the drawings where it is comprised of an expendible cup 10 such as may be formed of expanded polystyrene or the like as a single integral molded article including a circular side wall 11, a bottom 12 and a rim 13. A section 14 of a very thin flexible film such as polyethylene or the like, incapable of self support or shape retention is positioned in the cup 10 with its outermost portions 15 overlying the rim 13 of the cup and extending over the outer surface of the rim 13 of the cup 10 so as to cover the surface of the cup 10 against which a person's lips are engaged when drinking from said cup. The innermost or bottom portion of the film 14 is spaced with respect to the bottom 12 of the cup 10 by a beverage concentrate or the like such as instant coffee 16.

Those skilled in the art will observe that the expendible cup 10 may be easily and inexpensively formed on existing machinery and the film 14, for example a film having a thickness of one mil, may be quickly and economically assembled into the cup 10 following the addition of the beverage concentrate 16. The outermost portions 15 of the film 14 may be simultaneously shaped and attached to the outer surface of the cup 10 as by heat sealing or the like.

It will be understood by those skilled in the art that the cup may take any desired shape and that the beverage concentrate may comprise any such concentrate including soft drinks or the like as well as soups and cereals and other food products which become usable attractive articles of consumption upon being mixed with hot or cold water, milk or other liquid.

Measured dosages of medicines may be packed in place of the beverage concentrate.

Figure 2:
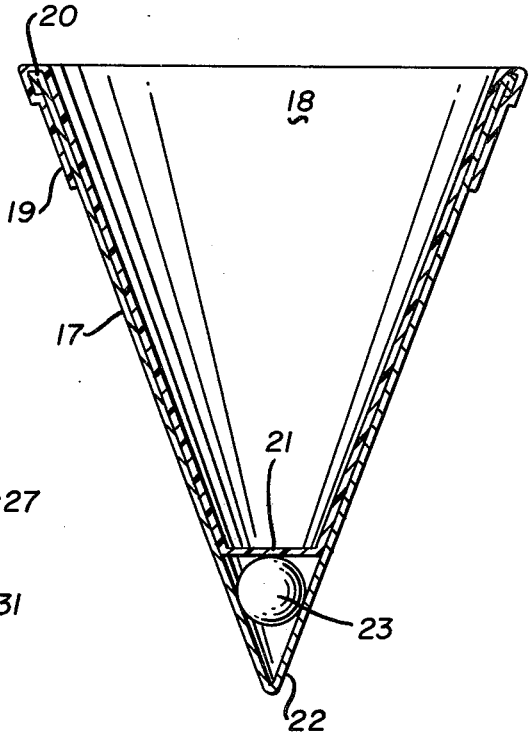
FIG. 2 is a vertical section through a flat foldable paper cup illustrating a modification of the invention.

By referring now to FIG. 2 of the drawings, one such change is illustrated wherein a cone-shaped paper cup 17 which may be thin walled plastic or the like, is illustrated with a similarly sized and shaped film section 18 disposed therein. The outermost portion 19 of the film 18 is extended over the rim 20 of the cup 17 so as to cover the surfaces of the cup 17 against which a person's lips are engaged when drinking from said cup. The film is detachably secured to the cup 17. The innermost or bottom portion 21 of the film 18 is spaced with respect to the cone-shaped bottom 22 of the cup 17 to cage a tablet 23. The tablet 23 may comprise an aspirin tablet, analgesic tablet or any other medicine.

In order to make a cup of coffee from the concentrate 16 illustrated in FIG. 1 of the drawings and heretofore described, the outermost portion 15 of the film 14 is detached from its engagement with the cup 10 and the film 14 lifted out of the cup 10 completely whereupon boiling water may be added to the instant coffee concentrate 16. A similar action exposes the tablet 23 in the cone-shaped bottom 22 of FIG. 2 of the drawings.

Figure 3:
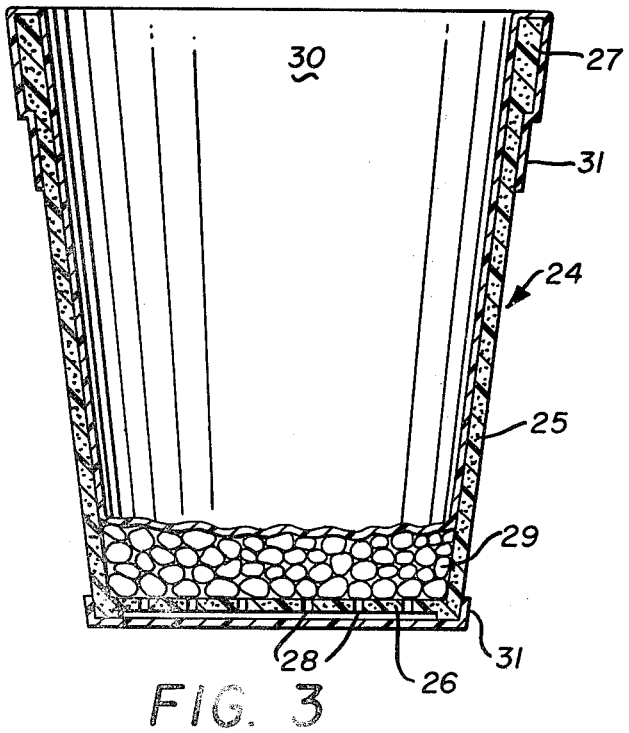
FIG. 3 is a vertical section through a single use cup embodying the invention and illustrating a further modification thereof.

In FIG. 3 of the drawings a further modification is illustrated wherein a single use cup 24 such as may be formed of expanded polystyrene or the like, has a circular side wall 25, a bottom 26, a rim 27 and a plurality of apertures 28 are formed in the bottom 26. A beverage concentrate 29 is placed in the cup 24, the beverage concentrate 29 is of a size so that it cannot pass through the apertures 28. A section of film 30 formed of a very thin flexible material such as polyethylene or the like is positioned in the cup 24. An outermost portion 31 of the film 30 overlies the rim 27 of the cup and extends downwardly over the rim 27 and over a portion of the circular wall 25. The film 30 is then vacuum formed into and against the circular side wall 25 and down against the beverage concentrate 29 by a vacuum device as known in the art. The cup 24 is then dipped into a fast drying film forming liquid forming a seal 31 permanently closing the apertures 28.

It will thus be seen that a coffee cup and container for a beverage concentrate or the like has been disclosed which is readily adaptable to various forms of single use cups and the like including the expanded polystyrene cups illustrated in FIGS. 1 and 3 of the drawings and the paper or thin walled plastic cup of FIG. 2 of the drawings. The cup of the invention is germ free, sterilized at the time of manufacture. Additionally the cup in FIG. 2 can be one of the cups which is packaged in flattened shape and is opened into its cup-shape at the time of use whereupon the plastic liner would be removed to expose the tablet or the like.

Although but three embodiments of the present invention have been illustrated and described, it will be apparent to those skilled in the art that various changes and modifications may be made therein without departing from the spirit of the invention and having thus described my invention what I claim is:

1. The combination of a beverage cup for dispensing a single portion of a beverage from a beverage concentrate contained within the cup, said cup comprising a drinking receptacle having a bottom and side walls with said side walls defining a rim, the bottom and lowermost portion of said walls defining an area for said beverage concentrate; and a section of an impervious very thin flexible film removably positioned inside the cup and detachably secured only to the outer surface of the cup side walls adjacent the rim of the cup to extend over the rim and down the outer side walls of said cup in an overlapping manner to cover all of the outer surface of the side wall adjacent the rim, said liner being spaced from the drinking receptacle bottom and defining a chamber enclosing said beverage concentrate between said film and the bottom and lower side walls of said cup, that portion of the liner overlapping the rim normally covering all of the surfaces of the outer side walls of said cup against which a person's lips are engaged when drinking from said cup to maintain such surfaces germ free and sterilized, said film contacting the inner surface of said cup walls in a nonadhering manner so said film can be removed prior to activating said beverage concentrate.

2. The combination set forth in claim 1 wherein the film is a plastic film that is heat sealable to said cup.

3. The combination set forth in claim 1 and wherein the cup is cone-shaped and the beverage concentrate is positioned in the apex of the cone and the film is spaced with respect to said apex to accommodate said beverage concentrate.

4. The combination set forth in claim 1 and wherein small openings are formed in the bottom thereof to facilitate vacuum forming said film section in said cup enclosing said concentrate and closure means is positioned under said openings.

5. The combination set forth in claim 4 and wherein said closure means comprises an impervious film applied as a fast drying liquid.

* * * * *